US006101724A

United States Patent [19]

Halligan

[11] Patent Number: 6,101,724

[45] Date of Patent: Aug. 15, 2000

[54] POCKETKNIFE WITH EXPOSED BLADE

[75] Inventor: Ed Halligan, Sharpsburg, Ga.

[73] Assignee: GB II Corporation, Wilsonville, Oreg.

[21] Appl. No.: 09/080,130

[22] Filed: May 15, 1998

[51] Int. Cl.[7] ..... B26B 1/04

[52] U.S. Cl. ..... 30/161; 30/155

[58] Field of Search ..... 30/155, 160, 161

[56] References Cited

U.S. PATENT DOCUMENTS

| | | | |
|---|---|---|---|
| 825,093 | 7/1906 | Watson | 30/161 |
| 1,600,602 | 9/1926 | Schrade | 30/155 |
| 2,270,851 | 1/1942 | Schrade | 30/155 |
| 2,596,294 | 5/1952 | Schrade | 30/161 |
| 4,347,665 | 9/1982 | Glesser | 30/161 |
| 5,111,581 | 5/1992 | Collins | 30/160 |
| 5,400,509 | 3/1995 | Collins | 30/161 |
| 5,537,750 | 7/1996 | Seber et al. | 30/161 |
| 5,546,662 | 8/1996 | Seber et al. | 30/161 |

OTHER PUBLICATIONS

Columbia River Knife & Tool, Product Brochure, Jan. 29, 1998, p. 2.

*Primary Examiner*—Hwei-Siu Payer
*Attorney, Agent, or Firm*—Stoel Rives LLP

[57] ABSTRACT

A locking-blade pocketknife includes an elongate handle having side margins that define a boundary of a side major surface of the handle. A blade is pivotally connected at its heel to a pivot end of the handle and adjacent the side major surface of the handle for movement between a folded position and an extended position. An exposed outer side of the blade remains exposed in die folded position. A cutting edge of the blade is located within the boundary of and in proximity to the side major surface of the handle when the blade is in the folded position to prevent a user touching the folded blade from being cut. A stop bolt mounted on tee handle limits the pivotal movement of the blade to approximately 180°. A locking mechanism for releasably locking the blade in Ore extended position comprises a spring portion of the handle. A detent formed in the blade adjacent the Sue engages a raised surface located on the spring portion to releasably hold the blade in the folded position and prevent accidental extension of the blade.

19 Claims, 4 Drawing Sheets

POCKETKNIFE WITH EXPOSED BLADE

TECHNICAL FIELD

The present invention relates to pocketknives in which a blade is pivotally mounted to a handle for movement between a folded position and an extended position and, in particular, to a locking-blade pocketknife having a blade with a cutting edge that remains exposed when the blade is in the folded position in such a manner that a user touching the blade cannot be cut by the cutting edge.

BACKGROUND OF THE INVENTION

Pocketknives commonly include a blade pivotally mounted to a handle, which includes a pocket for receiving the blade to protect a user from being cut by a cutting edge of the blade. When the blade is pivoted to a folded position, the cutting edge lies deep within the pocket of the handle, which allows the pocketknife to be safely and conveniently carried in a shirt pocket or a trouser pocket of a user. A top edge of the blade located opposite the cutting edge remains exposed beyond an aperture of the pocket of the handle when the blade is in the folded position. Blades commonly include a gripping device, such as a fingernail slot or thumbscrew, along the top edge of the blade to facilitate grasping or gripping the blade for extending it from the folded position. A problem with conventional pocketknives is that only a small portion of the blade remains exposed beyond the aperture of the pocket when the blade is in the folded position, making it difficult to grasp or grip the blade for extending it.

Common locking-blade pocketknives include a locking mechanism for automatically locking the blade in place when fully extended for increased safety when the pocketknife is in use, The locking mechanism is manually disengaged by the user by depressing a spring or latch, allowing the blade to be manually pivoted back to the folded position.

One known locking mechanism is a locking liner. In a locking liner, a thin metal liner forms an interior major side surface of the pocket of the handle and includes a spring member biased toward the blade. To prevent the blade from pivoting when in the extended position, an end of the spring member automatically extends behind a heel of the blade to contact the heel of the blade when the blade is fully pivoted to the extended position. A portion of the spring member extends beyond the aperture of the pocket so that the spring member may be manually flexed to disengage it, allowing the blade to be manually pivoted back to the folded position. A problem with locking liners is that the end of the spring member that contacts the heel of the blade has a small surface area that receives heavy wear caused by rubbing against the heel of the blade. With repeated use, this wear can cause the fit of the locking liner to become sloppy, allowing the blade to move slightly in the locked position.

SUMMARY OF THE INVENTION

An object of the invention is, therefore, to provide a pocketknife having a blade pivotally mounted adjacent a handle so that an outer side of the blade remains exposed when the blade is in a folded position to facilitate grasping the blade to pivot it from the folded position to an extended position.

Another object of the invention is to provide such a pocketknife in which a user touching an exposed cutting edge of the blade cannot be cut by the cutting edge when the blade is in the folded position.

A further object of the invention is to provide such a pocketknife that includes a manually disengageable locking mechanism having improved durability and wear resistance.

Yet another object of the invention is to provide such a locking mechanism that includes a retaining mechanism for releasably holding the blade in the folded position to prevent accidental extension of the blade and that allows the blade to be conveniently extended and folded with one hand.

Still another object of the invention is to provide such a pocketknife that is made from a reduced number of components to decrease manufacturing costs.

The present invention is a locking-blade pocketknife that includes an elongate handle having side margins that define a boundary of a generally planar side major surface, and a blade pivotally connected at its heel to a pivot end of the handle and adjacent the side major surface of the handle for movement between a folded position and an extended position. The blade includes a generally planar flat side located adjacent the handle and an outer side opposite the flat side that remains exposed in the folded position. A cutting edge is formed in the blade substantially in the plane of the flat side such that the cutting edge is located within the boundary of and in proximity to the side major surface of the handle when the blade is in the folded position to prevent a user touching the folded blade from being cut. A collared bearing nut extends through a pivot hole in the pivot end of the handle, through a mounting hole in the heel of the blade, and through an antifriction washer interposed between the handle and the blade; and fastens to a round head bolt to pivotally join the handle to the blade. A stop bolt is connected to a threaded hole in the side major surface of the handle and includes a head that protrudes from the side major surface to limit the pivotal movement of the blade to approximately 180° relative to the handle.

The pocketknife includes a locking mechanism for releasably locking the blade in the extended position, comprising a spring portion of the handle biased in the direction of the blade. When the blade is fully extended, the spring portion of the handle automatically extends behind the heel of the blade so that a contact surface of the spring portion presses against a lock pad on the heel to capture the blade between the spring portion and the stop bolt. The spring portion is manually depressed to unlock the blade for pivoting back to the folded position. A thin section is formed in the handle where the spring portion joins the handle to decrease the force necessary to depress the spring portion.

A releasable retaining mechanism includes a detent formed in the blade for receiving a raised surface located on the spring portion when the blade is in the folded position to releasably hold the blade in the folded position. The raised surface is hemispherical to facilitate release of the retaining mechanism. A knob or fingernail slot is located on the blade opposite the handle to facilitate the grip of a user when pivoting the blade. The blade, knob, retaining mechanism, and locking mechanism are arranged so that the blade can be pivoted and the locking mechanism can be released conveniently by the user using a single hand.

A clip is fastened to the handle near the pivot end of the handle and extends along the handle opposite the blade for holding items between the clip and the handle. A butt of the handle opposite the pivot end of the handle includes an eyelet for receiving a key ring.

Additional objects and advantages of this invention will be apparent from the following detailed description of preferred embodiments thereof which proceeds with reference to the accompanying drawings.

DETAILED DESCRIPTION OF PREFERRED EMBODIMENT

Figure 2:
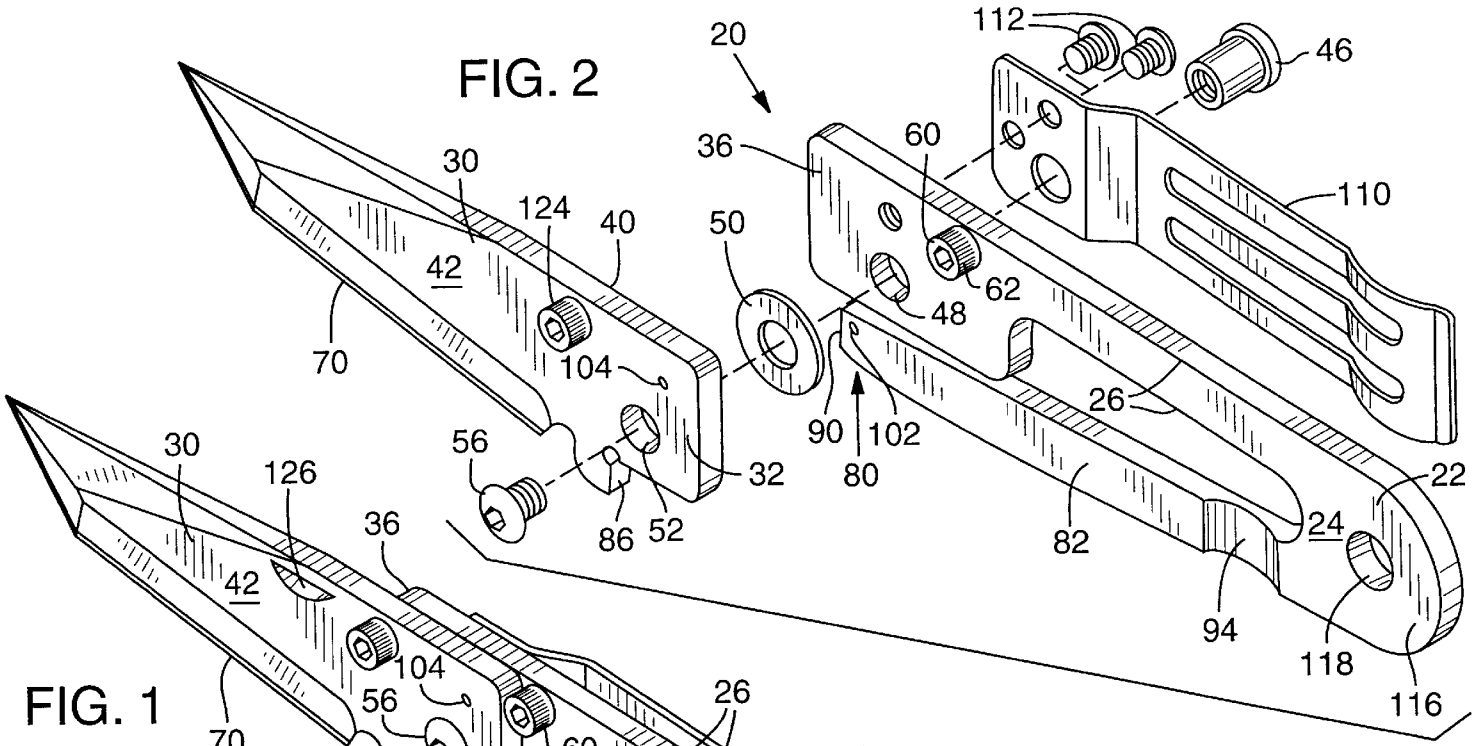
FIG. 2 is an exploded perspective view of the pocketknife of FIG. 1.
Figure 1:
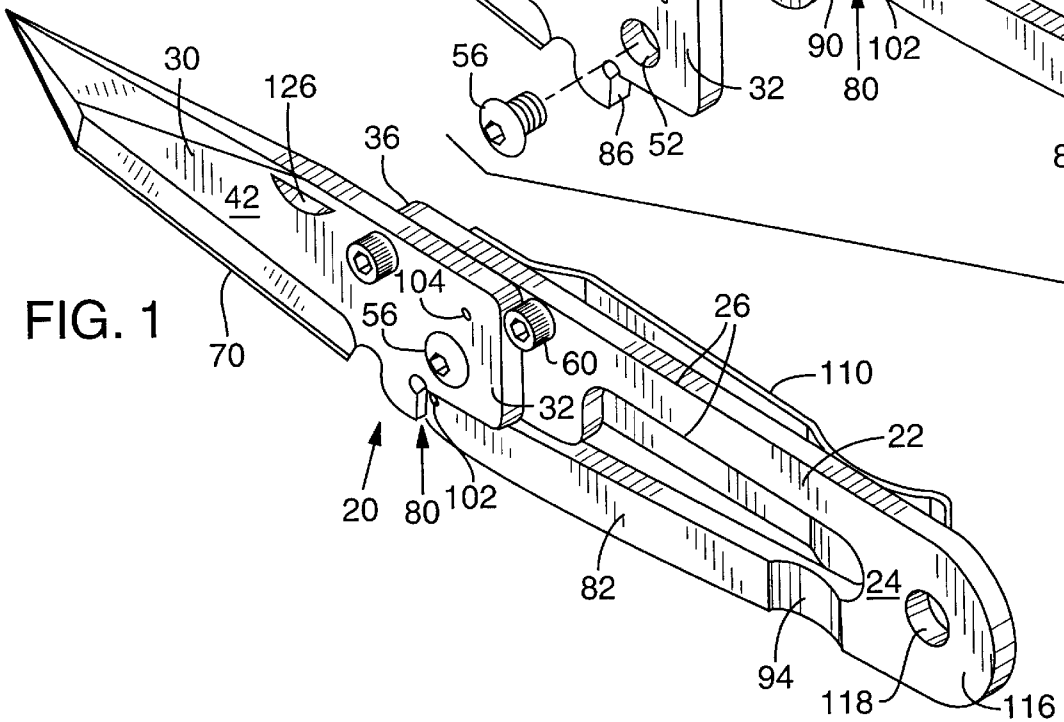
FIG. 1 is a perspective view of a pocketknife in accordance with the present invention with its blade shown in an extended and locked position.
Figure 3:
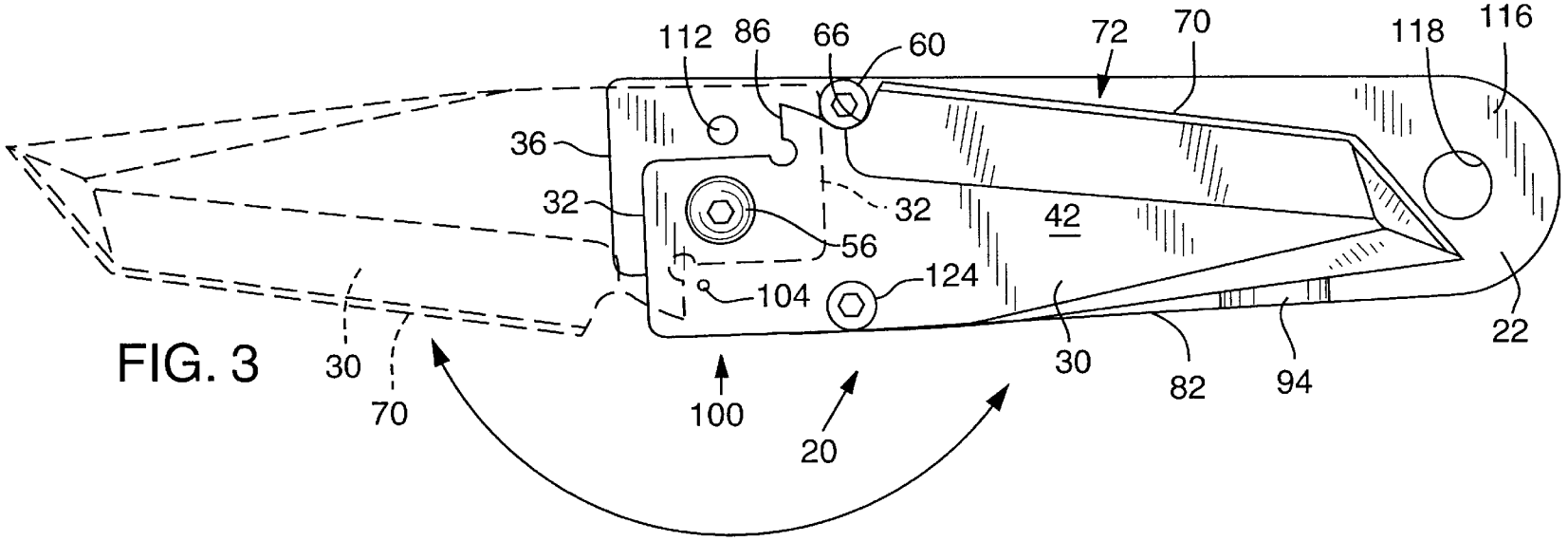
FIG. 3 is a front elevational view of the pocketknife of FIG. 1 with the blade shown in the fold position with solid lines and in the extended position with phantom lines.
Figure 4:
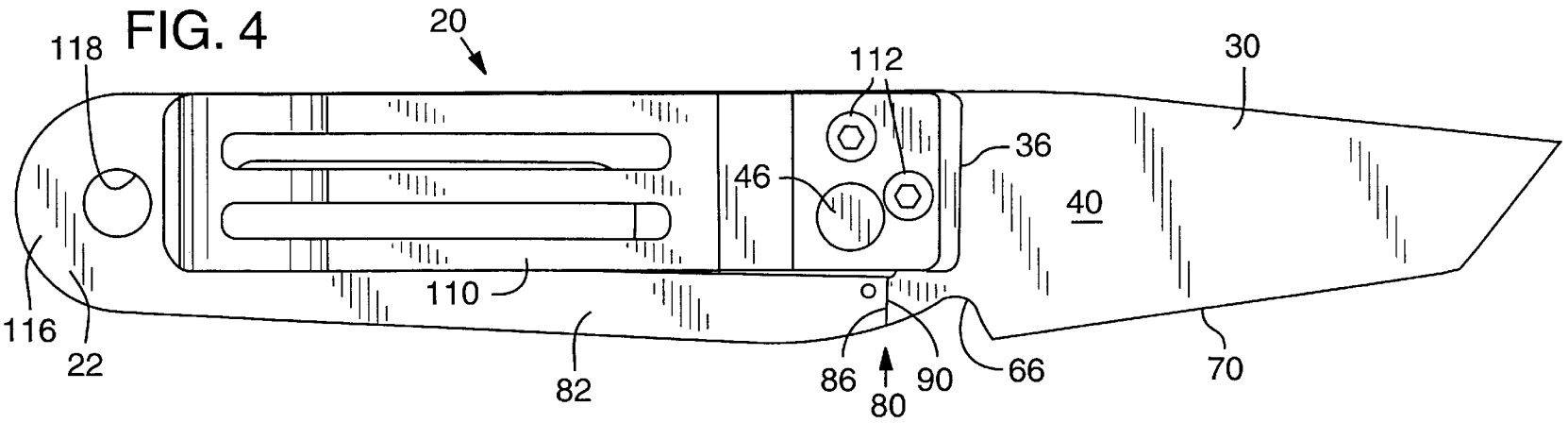
FIG. 4 is a back elevational view of the pocketknife of FIG. 1.
Figure 5:
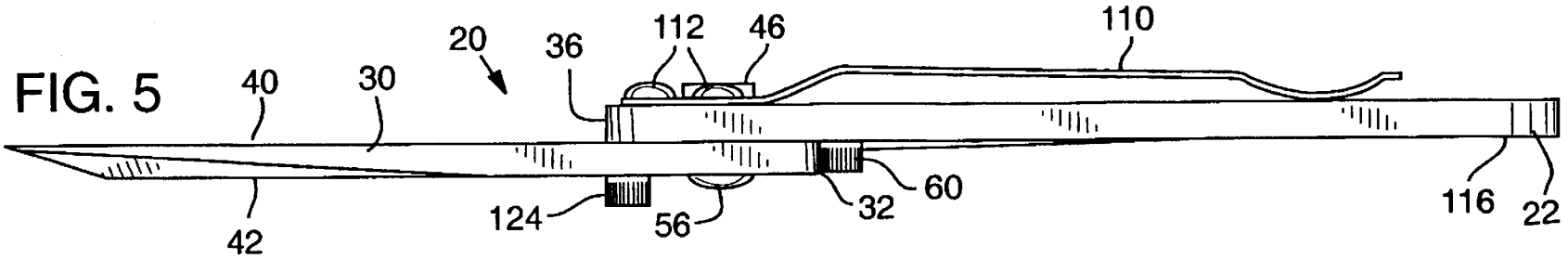
FIG. 5 is a top plan view of the pocketknife of FIG. 1.

FIG. 1 shows a pictorial view of a pocketknife 20, which represents a preferred embodiment of the present invention. FIG. 2 shows an exploded assembly view of pocketknife 20. With reference to FIGS. 1–2, pocketknife 20 includes an elongate handle 22 having a generally planar side major surface 24 bounded by margins 26. A blade 30 is pivotally connected at its heel 32 to a pivot end 36 of handle 22 adjacent side major surface 24 for movement between an extended position as shown in FIG. 1 and a folded position (FIG. 3). Blade 30 includes a generally planar flat side 40 positioned adjacent side major surface 24 and an outer side 42 opposite flat side 40, which remains exposed when blade 30 is in the folded position. A collared bearing nut 46 extends through a pivot hole 48 in pivot end 36 of handle 22, through an antifriction washer 50, and through a mounting hole 52 in heel of blade 30; and fastens to a round head bolt 56 to pivotally join handle 22 to blade 30.

FIG. 3 shows a front elevational view of pocketknife 20 with blade 30 shown in the folded position with solid lines and in the extended position with phantom lines. With reference to FIGS. 1–3, a stop bolt 60 is mounted to side major surface 24 and includes a head 62 that protrudes from side major surface 24 to limit the pivotal movement of blade 30 to approximately 180° relative to handle 22. When blade 30 is in the folded position, a notch 66 in blade 30 rests against head 62 of stop bolt 60. When blade 30 is in the extended position, heel 32 rests against head 62.

A cutting edge 70 is formed in blade 30 substantially in the plane of flat side 40. When blade 30 is in the folded position, cutting edge 70 is located within margins 26 of side major surface 24 and in proximity to side major surface 24 to define a gap 72 between cutting edge 70 and side major surface 24. Gap 72 has a width preferably ranging from about 0.005 cm to about 0.051 cm (0.002 to 0.020 inch) so that a user touching blade 30 cannot be cut by cutting edge 70 when blade 30 is in the folded position. Antifriction washer 50 is preferably formed of a plastic such as TEFLON having a thickness ranging from about 0.375 mm to about 0.5 mm (0.015–0.020 inch) appropriate to maintain gap 72 within the dimensional tolerance defined above.

Figure 6:
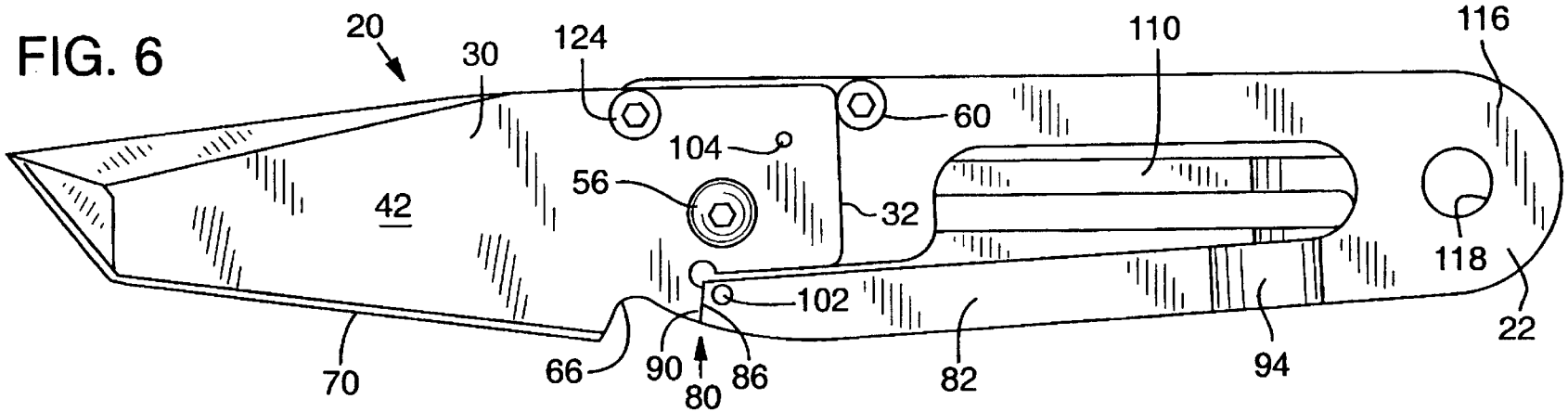
FIG. 6 is a front elevational view of the pocketknife of FIG. 1.
Figure 7:
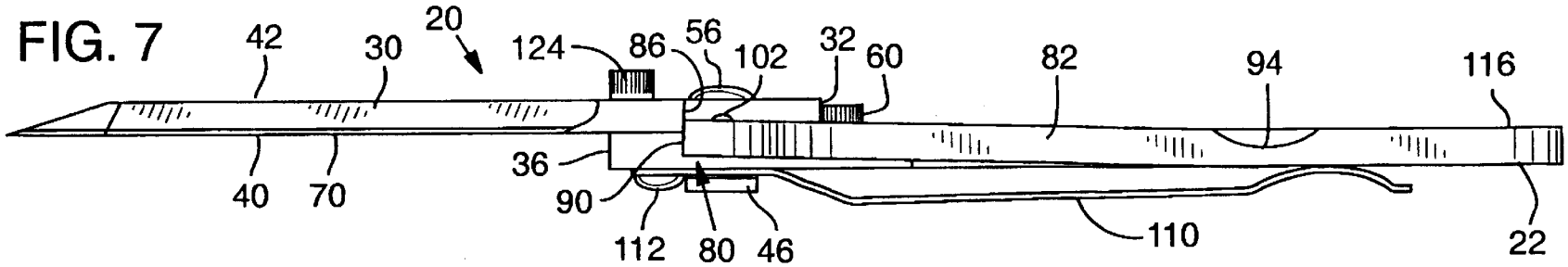
FIG. 7 is a bottom plan view of the pocketknife of FIG. 1.
Figure 9:
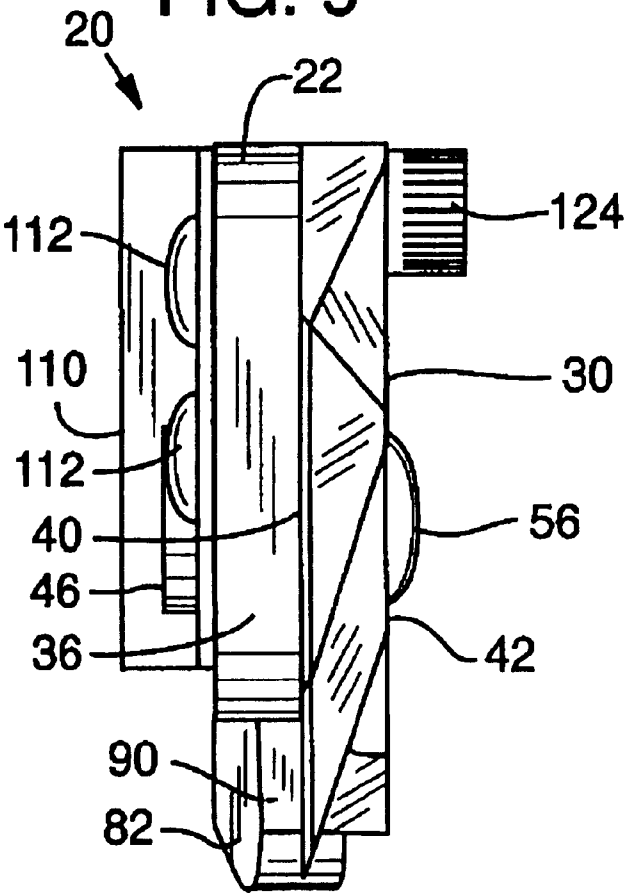
FIG. 9 is a left side view of the pocketknife of FIG. 1.
Figure 8:
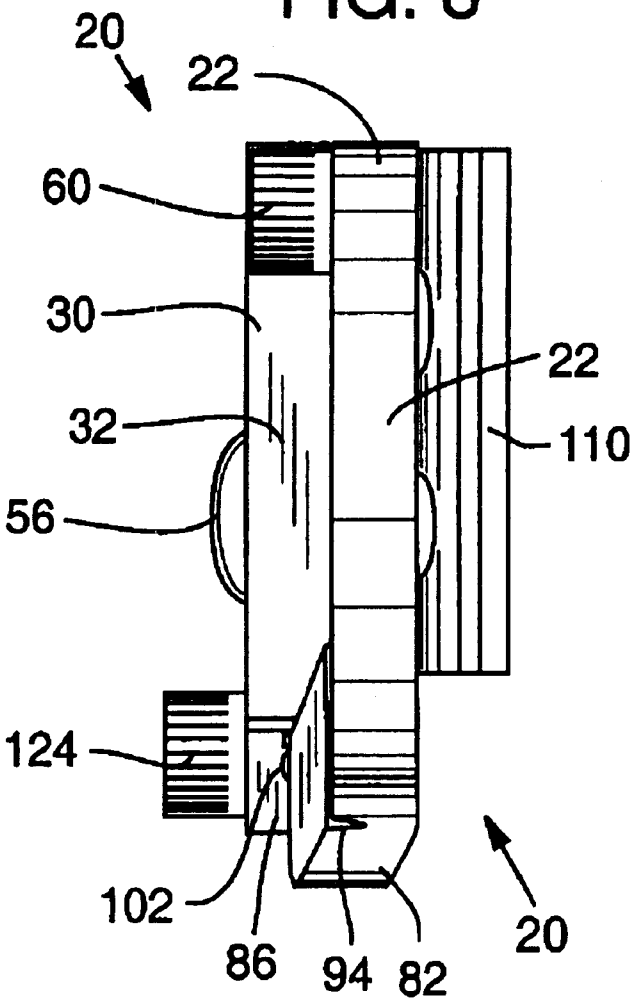
FIG. 8 is a right side view of the pocketknife of FIG. 1.

FIGS. 4, 5, 6, 7, 8, and 9 show back, top, front, bottom, right, and left views, respectively, of pocketknife 20 in the extended position. With reference to FIGS. 1–9, pocketknife 20 includes a locking mechanism 80 for automatically locking blade 30 in place when blade 30 is pivoted to the extended position. Locking mechanism 80 comprises a spring portion 82 of handle 22 biased in the direction of blade 30. Spring portion 82 is sized to automatically extend behind a lock pad 86 formed in heel 32 of blade 30 when blade 30 is fully pivoted to the extended position. Spring portion 82 terminates in a contact surface 90. With particular reference to FIG. 7, contact surface 90 is angled slightly, i.e., from about 2° to about 10° degrees from normal, so that, in conjunction with precise fitting of spring portion 82, contact surface 90 presses against lock pad 86 to firmly capture blade 30 between spring portion 82 and head 62 of stop bolt 60. Heel 32 of blade 30, handle 22, and spring portion 82 are all approximately 0.305 cm (0.120 inch) thick, which gives contact surface 90 and lock pad 86 surface areas that are much larger than contact surfaces on prior art locking devices. These increased surface areas yield wear resistance and durability of lock mechanism 80 that are improved over the prior art. Locking mechanism 80 is released by manually depressing spring portion 82. To decrease the force necessary to depress spring portion 82, a thin section 94 is formed in handle 22 where spring portion 82 joins handle 22.

With reference to FIGS. 1, 2, 6, and 7, pocketknife 20 includes a releasable retaining mechanism 100 for releasably holding blade 30 in place when blade 30 is in the folded position to prevent accidental extension of blade 30. Retaining mechanism 100 includes a raised surface 102 positioned on spring portion 82 of handle 22 and extending toward flat side 40 of blade 30. A detent 104 is positioned in heel 32 of blade 30 for engagement with raised surface 102 when blade 30 is in the folded position. As shown in FIG. 6, detent 104 may consist of a small hole drilled through or formed in blade 30. Alternatively, detent 104 may be a blind bore (not shown) formed in flat side 40 of blade 30 near heel 32. Raised surface 102 is preferably hemispherical with a major diameter of about 1.5 to about 2.5 times the diameter of detent 104 to facilitate the smooth release and operation of retaining mechanism 100.

With reference to FIGS. 1, 2, 4, 5, and 7, pocketknife 20 includes a clip 110 preferably formed of spring steel and mounted with threaded fasteners 112 to handle 22 opposite side major surface 24. Clip 110 is particularly useful for holding small items, such as paper currency, between clip 110 and handle 22 and for carrying or storing pocketknife 20, i.e., by attaching clip 110 to a belt (not shown) of a user. A butt 116 of handle 22 opposite pivot end 36 includes an eyelet 118 for receiving items such as key rings and leashes (not shown).

Blade 30 includes a gripping device 124 to facilitate the grip of a user when pivoting blade 30. In a preferred embodiment, gripping device 124 is a bolt mounted on outer side 42 of blade 30. However, gripping device 124 may also include a fingernail slot 126 (FIG. 1) or other device to facilitate the manual application of the leverage necessary to pivot blade 30. In the configuration shown in FIGS. 1–9, blade 30, gripping device 124, retaining mechanism 100, and locking mechanism 80 are arranged so that blade 30 can be pivoted and locking mechanism 80 can be released conveniently by a user using a single hand.

Handle 22 and blade 30 are preferably fine blanked of a high-carbon chromium stainless steel alloy such as AUS6M, but may also be formed of other materials appropriate for maintaining the sharpness of cutting edge 70, the spring properties of spring portion 82, and the overall durability of pocketknife 20. Cutting edge 70, contact surface 90, and lock pad 86 may be treated with a wear resistant treatment or coating such as tungsten carbide to improve wear resistance of locking mechanism 80.

It will be obvious to those having skill in the art that many changes may be made to the details of the above-described embodiment of this invention without departing from the underlying principles thereof. The scope of the present invention should, therefore, be determined only by the following claims.

What is claimed is:

1. A pocketknife, comprising:

a handle having a pivot end, a bun end, and side margins defining a boundary of an open side major surface, the handle formed to provide an integral locking mechanism that includes a spring portion extending in a direction away from the bun end and terminating at a free end in proximal location to the pivot end, the free end having a contact surface;

a mechanical stop positioned at a location on a portion of the handle other than the spring portion; and a blade including a cutting edge positioned between a blade tip and a blade heel and pivotally mounted to the pivot end of the handle and adjacent the open side major surface of the handle for pivotal movement in a first direction from an extended position toward a folded position and in a second direction from the folded position toward the extended position, the blade heel including a lock pad, the blade when in the extended position being locked in place by contact between the blade heel and the mechanical stop positioned on the handle and by contact between the lock pad of the blade heel and the contact surface of the free end of the handle, and the blade when in the folded position being impeded from further pivotal movement in The first direction by contact between the blade and the mechanical stop positioned on the handle, the location of the mechanical stop keeping the cutting edge of the blade within the boundary of the handle when the blade is in the folded position so that, although the cutting edge remains exposed, a user touching the blade cannot be cut by the cutting edge when the blade is in the folded position.

2. The pocketknife of claim 1 in which the blade pivotally moves about a pivot axis and in which the location of the mechanical stop is proximal to the pivot axis.

3. The pocketknife of claim 1, further comprising a raised surface positioned at the free end of the spring portion and a detent positioned at the blade heel, the raised surface and te detent positioned at locations such that the raised surfaced fits within the detent to provide a releasably locked fit for the blade in the folded position and thereby prevent accidental extension of the blade.

4. The pocketknife of claim 1 in which the spring portion includes a thin section located nearer to the butt end of the handle to provide leaf spring action that facilitates user forcible movement of the free end of the spring portion to release contact between the lock pad of the blade heel and the contact surface of the free end of the handle for the purpose of moving of the blade from the extended position to the folded position.

5. The pocketknife of claim 1 in which the mechanical stop comprises a stop bolt.

6. The pocketknife of claim 1 in which the blade further comprises a gripping device positioned away from the cutting edge to facilitate pivotal movement of the blade relative to the handle between the folded and extended positions.

7. The pocketknife of claim 6 in which gripping device comprises a bolt.

8. The pocketknife of claim 1 in which the handle has a blade-free side major surface opposite the open side major surface and further comprising a spring clip mounted to the handle for holding an item between the spring clip and the handle.

9. The pocketknife of claim 1 in which the blade is pivotally mounted to the handle by an adjustable pivot screw.

10. The pocketknife of claim 1 in which the cutting edge extends between distal and proximal ends, the distal end defining the blade tip, the pocketknife further comprising a notch positioned between the proximal end of the cutting edge and the blade heel and shaped to receive the mechanical stop when the blade is in the folded position.

11. The pocketknife of claim 10 in which the mechanical stop comprises a stop bolt having a head and in which the notch has an arcuate surface sized so that the head of the stop bolt fits in the notch.

12. A pocketknife, comprising:

a handle having side margins that define a boundary of a side major surface of the handle; and a blade pivotally mounted to the handle for folding between an extended position and a folded position, the blade including opposing exterior and interior surfaces that meet to form a cutting edge, the interior surface proximal to the side major surface of the handle when the blade is in the folded position, the exterior surface distal of the side major surface of the handle and forming an outermost surface of the pocketknife when the blade is in the folded position, the cutting edge located within the boundary of the handle and in proximity to the side major surface of the handle when the blade is in the folded position to prevent user injury.

13. The pocketknife of claim 12, further comprising a gripping device for manually extending the blade.

14. The pocketknife of claim 12, further comprising a locking device for locking the blade in the extended position.

15. The pocketknife of claim 14 in which the locking device includes:

a spring portion; and a flexible thin section that connects the spring portion to the handle so that the spring portion is biased to releasably lock the blade in the extended position.

16. The pocketknife of claim 12, further comprising a retaining mechanism for releasably holding the blade in the folded position to prevent accidental extension of the blade.

17. The pocketknife of claim 12 in which the blade includes a detent and the handle includes a spring portion positioned for releasably locking the blade in place when the blade is moved to the extended position, the spring portion having a raised surface sized for engagement with the detent when the blade is in the folded position to releasably hold the blade in the folded position and thereby prevent accidental extension of the blade.

18. The pocketknife of claim 12 in which the handle includes a distal end and a medial end, and in which the blade includes a heel end pivotally mounted to the medial end of the handle, and further comprising:

a stop mounted to the handle near the medial end and positioned to limit movement of the blade between the extended and folded positions.

19. The pocketknife of claim 18 further comprising a locking device for locking the blade in the extended position, the locking device including a spring portion positioned for fly and releasably capturing the blade between the locking device and the stop when the blade is pivoted to the extended position.

* * * * *

UNITED STATES PATENT AND TRADEMARK OFFICE

CERTIFICATE OF CORRECTION

PATENT NO : 6,101,724

DATED : August 15, 2000

INVENTOR(S) : Ed Halligan

It is certified that error appears in the above-identified patent and that said Letters Patent are hereby corrected as shown below:

Abstract, line 7, "die" should read --the--; line 11, "tee" should read --the--; line 14, "Ore" should read --the--; line 16, "Sue" should read --handle--.

Column 1, line 35, "use," should read --use.--.

Column 3, line 9,, "fold" should read --folded--.

Column 5, line 7, "bun" should read --butt--; line 11, "bun" should read --butt--; line 30, "The" should read --the--; line 43, "te" should read --the--; line 43, "surfaced" should read --surface--; line 61, insert --the-- between "which" and "gripping".

Column 6, line 63, "fly" should read --firmly--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,101,724
DATED : August 15, 2000
INVENTOR(S) : Ed Halligan

It is certified that error appears in the above-identified patent and that said Letters Patent is hereby corrected as shown below:

Title page,
Insert item [30] to -- Foreign Application Priority Data

| | | |
|---|---|---|
| Dec. 6, 1997 | Taiwan | 86220330 |
| Dec. 6, 1997 | Taiwan | 86310436 --. |

Signed and Sealed this

Second Day of October, 2001

*Attest:*

Nicholas P. Godici

NICHOLAS P. GODICI
*Acting Director of the United States Patent and Trademark Office*

*Attesting Officer*

Disclaimer 6,101,724 — Ed Halligan, Sharpsburg, Ga. POCKETKNIFE WITH EXPOSED BLADE. Patent dated August 15, 2000. Disclaimer filed March 22, 2002, by the assignee, GB II Corp. Wilsonville, Oreg.

Hereby enter this disclaimer to all claims (1-19) of said patent.

*(Official Gazette, April 22, 2003)*